US010071886B2

(12) United States Patent
Blonden et al.

(10) Patent No.: US 10,071,886 B2
(45) Date of Patent: Sep. 11, 2018

(54) CRANE BUMPER CONTAINMENT SLEEVES

(71) Applicant: The Boeing Company, Chicago, IL (US)

(72) Inventors: James A. Blonden, Puyallup, WA (US); Michael A. Fritch, Orting, WA (US)

(73) Assignee: The Boeing Company, Chicago, IL (US)

( * ) Notice: Subject to any disclaimer, the term of this patent is extended or adjusted under 35 U.S.C. 154(b) by 306 days.

(21) Appl. No.: 14/956,788

(22) Filed: Dec. 2, 2015

(65) Prior Publication Data

US 2017/0158471 A1 Jun. 8, 2017

(51) Int. Cl.
*B66C 23/88* (2006.01)
*B66C 7/16* (2006.01)

(52) U.S. Cl.
CPC ..... *B66C 7/16* (2013.01); *B66C 23/88* (2013.01)

(58) Field of Classification Search
CPC .... B66C 7/00; B66C 7/02; B66C 7/10; B66C 23/88; B66C 7/16
See application file for complete search history.

(56) References Cited

U.S. PATENT DOCUMENTS 4,508,338 A * 4/1985 Kremski ..... A63D 15/06 29/450
5,478,514 A * 12/1995 Hamilton ..... D02G 3/328 264/103
6,332,713 B1 * 12/2001 Cohen ..... A45C 11/20 383/117
7,419,333 B2 * 9/2008 Bussey, Jr. ..... E02B 11/005 156/293
2012/0149263 A1 * 6/2012 Cvek ..... D03D 15/08 442/2
2014/0212067 A1 * 7/2014 Hicks ..... B63C 11/26 383/4

OTHER PUBLICATIONS

Kastalon, Inc. "Polyurethane Crane Bumpers", Brochure, [http://www.kastalon.com/crane-bumpers.php], 2015, 4 pages.

* cited by examiner

*Primary Examiner* — Mark T Le
(74) *Attorney, Agent, or Firm* — Hanley, Flight and Zimmerman, LLC

(57) ABSTRACT

An example apparatus includes a flexible sleeve to contain a bumper of a crane. The flexible sleeve includes a first end to be closed adjacent the bumper to contain the bumper in a cavity defined by the flexible sleeve. The first end of the flexible sleeve and the bumper are to couple to a first position of the crane via a fastener. The flexible sleeve includes a second end opposite the first end. The second end is to couple to a second position of the crane to prevent the bumper contained in the cavity from falling from the crane if the first end of the flexible sleeve decouples from the first position of the crane.

20 Claims, 6 Drawing Sheets

CRANE BUMPER CONTAINMENT SLEEVES

FIELD OF THE DISCLOSURE

This patent relates generally to cranes and, more particularly, to crane bumper containment sleeves.

BACKGROUND

Cranes often transport materials (e.g., raw materials, works-in-progress, finished goods, etc.) from one location to another location. Overhead or bridge cranes are often utilized in a manufacturing environment (e.g., warehouses) to transport materials between locations within the manufacturing environment. Some known overhead or bridge cranes include a bridge or trolley that moves along rails in a first direction to transport the materials in the first direction and which includes a hoist that moves along the bridge in a second direction (e.g., a direction perpendicular to the first direction) to transport the materials in the second direction. Some such cranes include a plurality of bridges or trolleys that run along the same rails to enable the cranes to transport materials simultaneously. In some instances, the bridges collide while moving along the rails of the crane. To reduce an amount of damage resulting from such collisions, some known overhead or bridge cranes include bumpers that absorb energy upon impact.

SUMMARY

In one example, an apparatus includes a flexible sleeve to contain a bumper of a crane. The flexible sleeve includes a first end to be closed adjacent the bumper to contain the bumper in a cavity defined by the flexible sleeve. The first end of the flexible sleeve and the bumper are to couple to a first position of the crane via a fastener. The flexible sleeve includes a second end opposite the first end. The second end is to couple to a second position of the crane to prevent the bumper contained in the cavity from falling from the crane if the first end of the flexible sleeve decouples from the first position of the crane.

In another example, an apparatus includes a crane bumper and a sleeve that includes a mesh wall containing the crane bumper. The sleeve includes a first sealed end. The crane bumper is contained by the mesh wall of the sleeve adjacent the first sealed end. A fastener that is coupled to the bumper extends through the mesh sleeve adjacent the first sealed end to couple the bumper to a first position of a crane. The sleeve includes a second sealed end opposite the first sealed end to couple to a second position of the crane.

In another example, a method includes extending a first fastener coupled to a crane bumper through a mesh wall of a sleeve adjacent a first sealed end of the sleeve. The crane bumper is contained within a cavity defined by the mesh wall adjacent the first sealed end. The method includes coupling the crane bumper and the first sealed end to a first position of a crane via the first fastener extending through the mesh wall. The method includes coupling a second sealed end of the sleeve opposite the first sealed end to a second position of the crane to prevent the crane bumper contained within the cavity of the sleeve from falling from the crane if the first sealed end of the sleeve decouples from the first position of the crane.

BRIEF DESCRIPTION OF THE DRAWINGS

The figures are not to scale. Instead, to clarify multiple layers and regions, the thicknesses of the layers may be enlarged in the drawings. Wherever possible, the same reference numbers will be used throughout the drawing(s) and accompanying written description to refer to the same or like parts.

DETAILED DESCRIPTION

Figure 1:
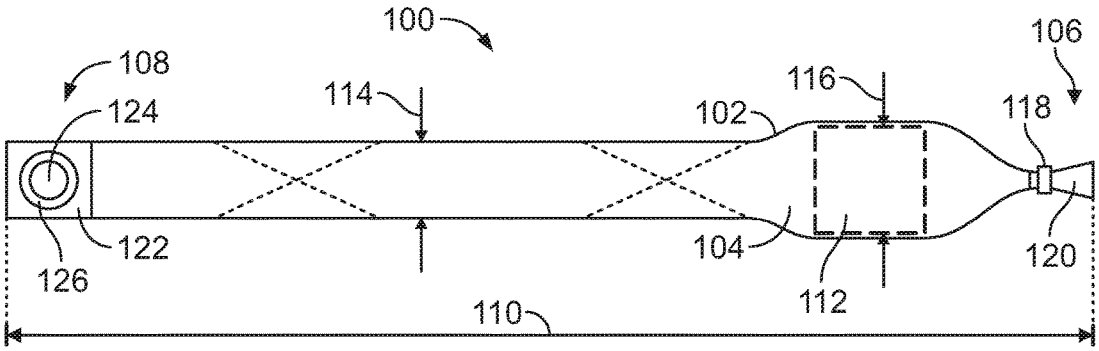
FIG. 1 depicts an example sleeve for containing a crane bumper in accordance with the teachings disclosed herein.

Many known cranes transport materials (e.g., raw materials, works-in-progress, finished goods, etc.) from one location to another location. For example, known overhead or bridge cranes transport materials between locations in a warehouse or other manufacturing facility. Some known overhead cranes include a hoist that lifts the materials from the ground and transports the materials to another location in the manufacturing facility. In some examples, the hoist is slidably coupled to a bridge or trolley of the crane. The hoist moves (e.g., rolls) along the bridge in a first direction (e.g., an x-direction) to enable the hoist to carry the materials in the first direction. Further, the bridge of such known overhead cranes is slidably coupled to parallel rails. The bridge moves (e.g., rolls) along the rails in a second direction (e.g., a y-direction, a direction perpendicular to the first direction) to enable the hoist to transport the materials in the second direction. The rails of such known overhead cranes are installed above ground to enable the hoist to transport the material above ground level or overhead. Some known overhead cranes enable material to be transported an entire width and/or length of a manufacturing facility in which the overhead crane is installed.

Some known overhead cranes include hoists and corresponding bridges that are slidably coupled to the same rails. For example, the hoists and corresponding bridges enable the overhead crane to transport simultaneously multiple loads of materials to different locations within the manufacturing facility. In some instances, because the bridges are slidably coupled to the same rails, the bridges may collide as one or more of the bridges moves along the rails.

The bridges of some known overhead cranes include bumpers to reduce and/or prevent damage to the bridges. For example, the bumpers are coupled to ends of the bridges that may otherwise collide with adjacent bridges of the overhead cranes. The bumpers are coupled to the ends of the bridges to prevent other portions of the bridge from being struck. Further, in some examples, the bumpers are composed of an elastomeric material (e.g., rubber) that absorbs energy upon impact. As a result, the bumpers reduce maintenance, repair, and/or replacement costs for bridges of overhead cranes.

In some examples, the bumpers are coupled to the ends of the bridges via a fastener. The bumpers may become damaged and/or deteriorate as a result of a high-energy collision and/or repeated collisions over time. For example, a portion of a bumper may separate from another portion of the bumper that remains coupled to the crane and fall to a surface below. Additionally or alternatively, the bumper or a portion of the bumper may separate from the fastener and/or the crane such that the bumper or a portion of the bumper falls to a surface below. As a result, the bumper and/or the portion of the bumper may create foreign object debris that rests on the ground and/or equipment (e.g., aircraft equipment) below and/or adjacent the crane.

The example apparatus described herein impede and/or prevent a portion of a crane bumper from falling from an overhead or bridge crane, to prevent foreign object debris from resting on the ground and/or equipment (e.g., aircraft equipment) below and/or adjacent the crane, and/or to provide a visual indicator that the crane has been damaged. An example apparatus disclosed herein includes a bumper (e.g., a crane bumper) and a sleeve (e.g., a flexible sleeve) to contain the bumper. The bumper is contained in a cavity defined by the sleeve adjacent a first end. For example, the first end is closed (e.g., sealed) adjacent the bumper to contain the bumper in the cavity of the sleeve adjacent the first end. To close the first end of the sleeve to contain the bumper within the cavity of the sleeve, the first end is sealed such as via knotting or crimping the sleeve and/or via coating the first end with a rubber coating.

The first end of the sleeve and the bumper of the example apparatus couple to a first position of a crane via a fastener. For example, the fastener is coupled to the bumper and extends through the sleeve adjacent the first end to couple the bumper and the first end of the sleeve to the first position of the crane. The example sleeve disclosed herein contains a portion (e.g., a first portion) of the bumper that separates and/or uncouples from another portion (e.g., a second portion) of the bumper that remains coupled to the crane. As a result, the example sleeve prevents the separated portion of the bumper from falling from the crane onto the ground and/or equipment (e.g., aircraft equipment) below and/or adjacent the crane and, thus, enhances the safety of people located below and/or adjacent the crane. Further, the example sleeve enhances safety by preventing separated portions the bumper from forming foreign object debris that rests on the ground and/or equipment (e.g., aircraft equipment) below and/or adjacent the crane.

Further, the sleeve of example apparatus disclosed herein includes a second end opposite the first end that is to couple to a second position of the crane. For example, the second end defines an aperture (e.g., via a grommet disposed in the second end) to receive a second fastener that is to couple the second end to the crane. In some examples, the second end of the sleeve is closed (e.g., sealed via a rubber coating) to contain a portion (e.g., a first portion) of the bumper that decouples from another portion (e.g., a second portion) of the bumper that remains coupled to the crane. By coupling the second end to the second position of the crane, the example sleeve further prevents the bumper from falling from the crane onto the ground below if the first end of the sleeve and the bumper decouple from the first position of the crane. For example, if the first end of the sleeve and the bumper separate from the crane, the bumper remains contained within the sleeve and the second end remains coupled to the crane to prevent the bumper from falling to the ground below. As a result, the second end of the sleeve coupled to the second position of the crane enhances the safety of people located below and/or adjacent the crane. Further, the example sleeve enhances safety by preventing separated portions the bumper from forming foreign object debris that rests on the ground and/or equipment (e.g., aircraft equipment) below and/or adjacent the crane. Additionally or alternatively, because the second end of the sleeve remains coupled to the second position of the crane when the first end and the bumper separate from the first position, the sleeve provides a visual indication that the bumper has separated from the crane.

In some examples, the sleeve is composed of a flexible mesh wall to enable the sleeve to expand to receive and enclose the bumper. For example, the flexible mesh wall enables the sleeve to contain bumpers having a diameter of about between 1 inch and 6 inches. Additionally or alternatively, the flexible mesh wall defines expandable openings that enable a fastener (e.g., a fastener having a diameter of about between ⅜ inches and 1 inch) to extend through the mesh wall and couple the bumper to the first position of the crane without damaging the mesh wall of the sleeve. When unexpanded (e.g., contracted), the openings of the flexible mesh wall are small enough to minimize amount of portions that may separate from the bumper traversing through the openings and falling to the ground below. In the illustrated example, the flexible mesh wall defines expandable openings that contain portions of the bumper within the cavity of the sleeve and enable a fastener having a diameter of about ⅜ inches to extend through the mesh wall without damaging the mesh wall (e.g., the flexible mesh wall defines an opening that is expandable to about ⅜ inches). Further, the sleeve is composed of a material that is capable of withstanding collisions with other objects (e.g., bridges of the crane) so that the sleeve does not deteriorate and/or enable the bumper to fall from the sleeve upon impact with the other object. For example, the sleeve is composed of a flexible and/or resilient woven elastomeric mesh (e.g., a woven mesh of polyphenylene sulfide) that enables the sleeve to expand around the bumper and is able to withstand collisions without deteriorating.

In some examples, the sleeve and the bumper are coupled to an end of a bridge (e.g., a trolley) of the crane to prevent an object (e.g., an adjacent second bridge of the crane) from contacting and damaging the end of the bridge. In other examples, the sleeve and the bumper are coupled to an end of a hoist to prevent an object from contacting and damaging the end of the hoist.

Further, the example sleeves described herein may be retrofitted onto previously installed cranes. For example, some cranes installed in the field include exposed bumpers that are coupled to the crane via corresponding fasteners. To retrofit the crane with the sleeve to minimize the number of portions of the bumper which may fall from the crane, the bumper may be decoupled from the crane (e.g., via decoupling the fastener from the crane), inserted into and enclosed within a cavity of the sleeve, and recoupled to the crane with the sleeve via the fastener.

Turning to the figures, FIG. 1 illustrates a flexible sleeve 100 in accordance with the teachings disclosed herein. The example sleeve 100 includes a wall 102 that defines a cavity 104, a first end 106, and a second end 108 opposite the first end 106. A length 110 of the sleeve 100 is defined between the first end 106 and the second end 108. In the illustrated example, the length 110 of the sleeve 100 is about 28 inches.

The wall 102 of the illustrated example is composed of a mesh so that the sleeve 100 is flexible and/or expandable.

For example, the wall 102 is a woven mesh composed of an elastomeric material such as polyphenylene sulfide. The woven mesh defines openings small enough to minimize portions of the bumper 112 from escaping the cavity 104 of the sleeve 100. As illustrated in FIG. 1, the flexible sleeve 100 expands around and receives a bumper 112 within the cavity 104 of the sleeve 100. The sleeve 100 has an unexpanded diameter 114 that is small enough to enable the sleeve 100 to securely receive a bumper having a first diameter and is expandable to securely receive a bumper having a second diameter larger than the first diameter. For example, the sleeve 100 can securely contain bumpers having diameters of about between 1 inch and 6 inches. In the illustrated example, the unexpanded diameter 114 of the sleeve 100 is about 1.75 inches and expands to securely receive the bumper 112 of a crane (e.g., a crane 400 of FIG. 4) having a diameter 116 of about 2.5 inches.

As illustrated in FIG. 1, the first end 106 and the second end 108 of the sleeve 100 are closed to contain the bumper 112 within the cavity 104 of the sleeve 100. For example, the first end 106 is closed to prevent the bumper 112 and/or a portion of the bumper 112 from escaping from the cavity 104 via the first end 106, and the second end 108 is closed to prevent the bumper 112 and/or a portion of the bumper 112 from escaping from the cavity 104 via the second end 108. In the illustrated example, the wall 102 of the sleeve 100 includes a knot or crimp 118 to close the first end 106. Additionally or alternatively, the first and second ends 106, 108 include respective rubber coatings 120, 122 that seal the sleeve 100 to enclose the bumper 112 and/or portions of the bumper 112 in the cavity 104 of the sleeve 100. In the illustrated example, to seal the first end 106 to prevent a portion of the bumper 112 from escaping the cavity 104 via the first end 106, the rubber coating 120 at the first end 106 extends about 1 inch along the sleeve 100 so that the rubber coating 120 covers the knot or crimp 118.

Figure 4:
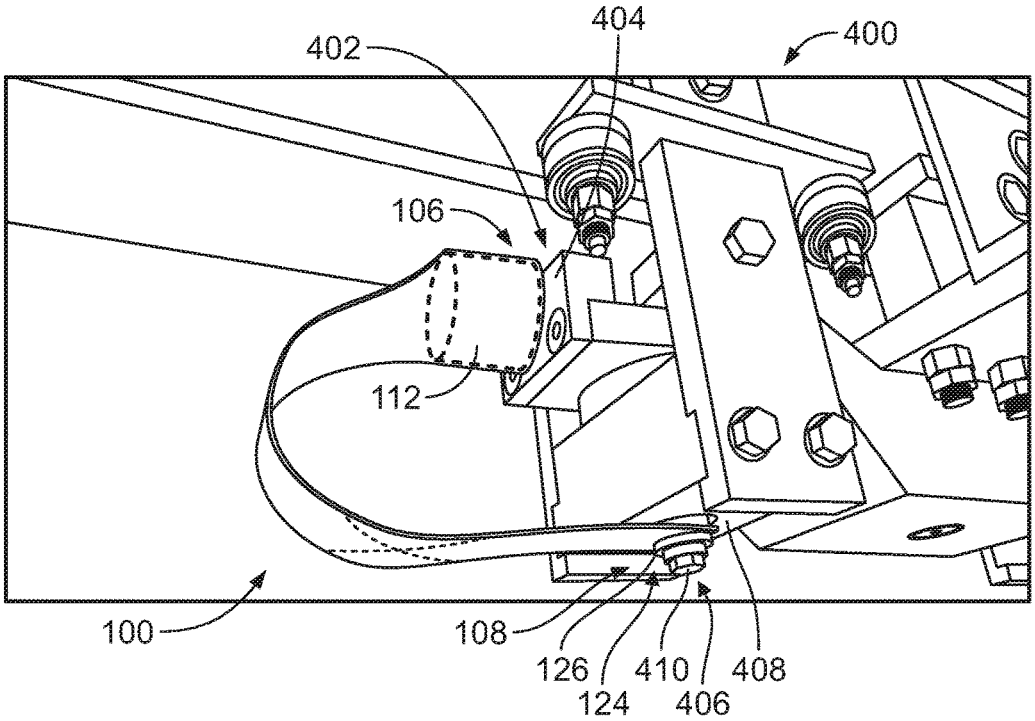
FIG. 4 is a perspective view of the sleeve and the crane bumper of FIGS. 1-3 coupled to a crane in accordance with the teachings disclosed herein.

As illustrated in FIG. 1, the second end 108 of the sleeve 100 defines an aperture 124 that is to receive a fastener (e.g., a second fastener 410 of FIG. 4) to couple the second end 108 of the sleeve 100 to a surface (e.g., a surface 408 of FIG. 4) of a crane (e.g., the crane 400 of FIG. 4). In the illustrated example, a grommet 126 is disposed in the second end 108 of the sleeve 100 to define the aperture 124. As illustrated in FIG. 1, the rubber coating 122 extends about 2 inches along the sleeve 100 at the second end 108 to prevent a portion of the bumper 112 from escaping the cavity 104 via the first end 106 and to enable the grommet 126 to be securely disposed in the second end 108 of the sleeve. The grommet 126 has an inner diameter that enables the aperture 124 to receive a fastener (e.g., the fastener 410) that is to couple to a surface (e.g., the surface 408 of FIG. 4) of a crane (e.g., the crane 400 of FIG. 4). For example, the grommet 126 has an inner diameter of about between ⅜ inches and 1 inch to enable the aperture 124 to receive a fastener of the crane 400 that has an outer diameter of about ⅜ inches and 1 inch.

Figure 2:
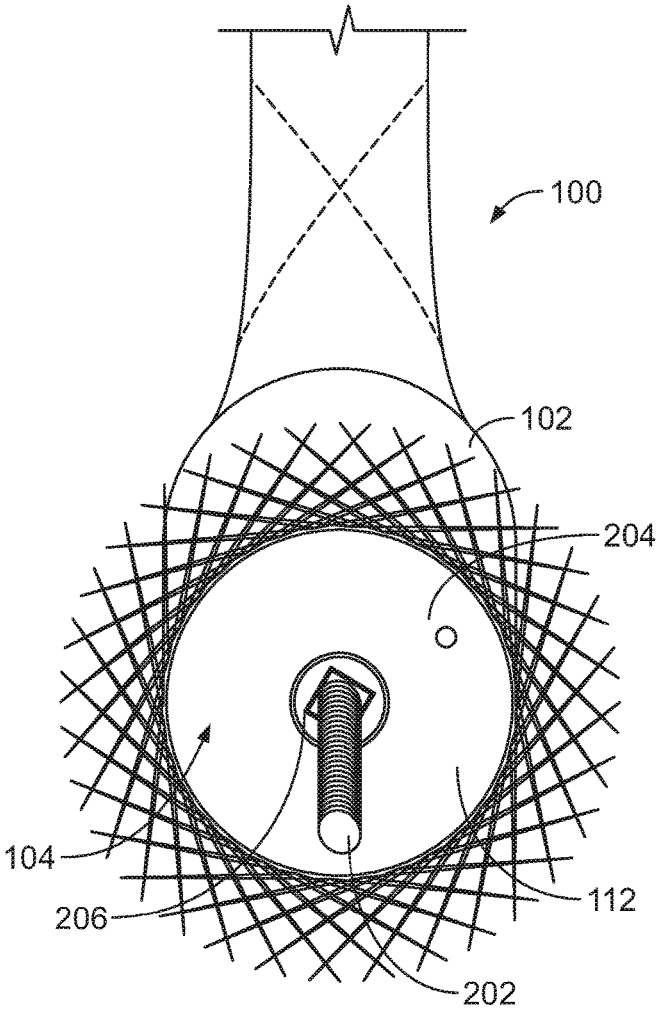
FIG. 2 depicts the crane bumper of FIG. 1 positioned in a cavity of the sleeve of FIG. 1.

FIG. 2 illustrates the bumper 112 positioned in the cavity 104 of the sleeve 100 defined by the wall 102. In the illustrated example, the first end 106 (FIG. 1) of the sleeve 100 is cut away to show the bumper 112 disposed in the cavity 104 of the sleeve 100. As illustrated in FIG. 2, a first fastener 202 extends from an end 204 of the bumper 112. For example, the fastener 202 extends in a direction toward the first end 106 of the sleeve 100. As illustrated in FIG. 2, the fastener 202 extends through an aperture 206 defined by the bumper 112. In some examples, the fastener 202 is fixedly coupled to the bumper 112. In other examples, the fastener 202 extends loosely through the aperture 206 without being fixed to the bumper 112.

Figure 3:
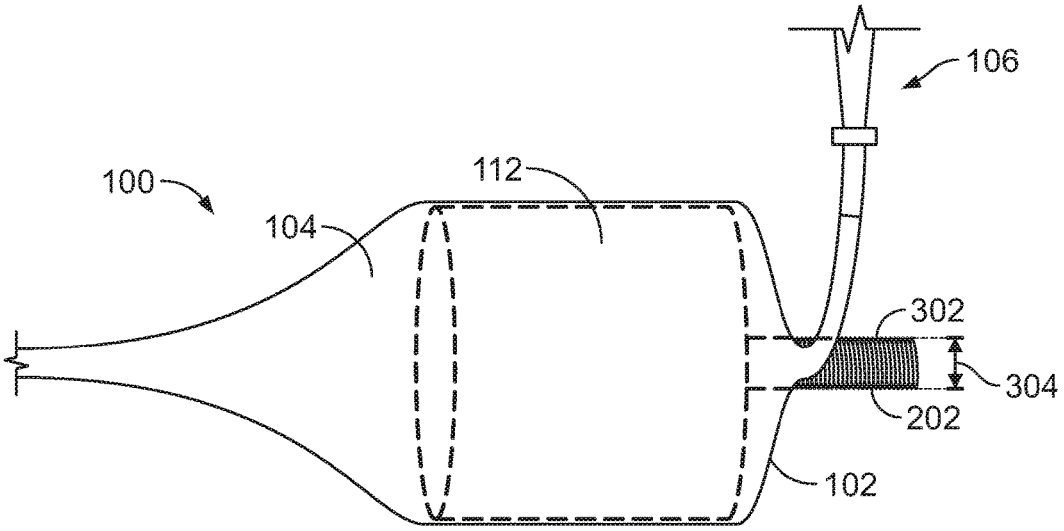
FIG. 3 depicts a fastener of the crane bumper of FIGS. 1-2 extending through the sleeve of FIGS. 1-2.

FIG. 3 illustrates the fastener 202 of the bumper 112 extending through the wall 102 of the example sleeve 100 adjacent the first end 106. As illustrated in FIG. 3, while the fastener 202 extends through the wall 102, the bumper 112 remains contained within the cavity 104 defined by the wall 102 of the sleeve 100. The fastener 202 extends through the wall 102 of the sleeve to couple the bumper 112 and first end 106 of the sleeve 100 to a surface (e.g., a first surface 404 of FIG. 4) of a crane (e.g., the crane 400 of FIG. 4). The fastener 202 of the illustrated example includes threads 302 that are to threadably couple to the crane 400.

As illustrated in FIG. 3, the first end 106 of the example sleeve 100 is bent or curled adjacent the bumper 112 to enable the fastener 202 to reach and extend through the wall 102 of the sleeve 100. For example, the first end 106 is bent or curled to be about perpendicular to the fastener 202 of the bumper 112. In the illustrated example, the fastener 202 that extends through the wall 102 of the sleeve 100 has a diameter 304 of about ⅜ inches. Thus, the wall 102 enables a fastener (e.g., the fastener 202) having a diameter of about ⅜ inches to extend through the sleeve 100. In some examples in which the wall 102 is composed of a mesh (e.g., a woven mesh of elastomeric material), the fastener 202 extends through an opening defined by the mesh without damaging the wall 102 of the sleeve 100. Thus, by being composed of a woven mesh of elastomeric material, the wall 102 enables the sleeve 100 to expand to receive the bumper, to expand to enable the fastener 202 to extend through without damaging the wall 102, and to contract to define openings small enough to prevent portions of the bumper 112 from escaping the cavity 104 of the sleeve 100.

FIG. 4 illustrates the example flexible sleeve 100 and the bumper 112 coupled to the crane 400 (e.g., a hoist, a bridge or trolley 500 of FIG. 5) in accordance with the teachings disclosed herein. The crane 400 is, for example, an overhead or bridge crane installed in a manufacturing facility. As illustrated in FIG. 4, the first end 106 of the sleeve 100 and the bumper 112 are coupled to the crane 400 at a first position 402 that is located along the first surface 404 of the crane 400. For example, the first surface 404 defines an aperture that receives the fastener 202 (FIGS. 2-3) to couple the bumper 112 and the first end 106 of the sleeve 100 to the first position 402 of the crane 400. In some examples, the aperture is threaded to threadably receive the threads 302 (FIG. 3) of the fastener 202.

In the illustrated example, the bumper 112 is coupled to the crane 400 at the first position 402 to prevent an object from colliding with, striking and/or otherwise contacting the first surface 404 and/or other nearby portions of the crane 400. In some instances, the bumper 112 may become damaged and/or deteriorate upon being struck by the object, thereby causing a portion of the bumper 112 to separate from another portion of the bumper 112 that remains coupled to the crane 400. In such instances, the sleeve 100 contains the separated portion of the bumper 112 to prevent it from falling from the crane 400 onto the ground below.

As illustrated in FIG. 4, the second end 108 of the sleeve 100 is coupled to the crane 400 at a second position 406 that is located along the second surface 408 of the crane 400. In the illustrated example, the second surface 408 is adjacent and perpendicular to the first surface 404. The second end 108 of the sleeve 100 of the illustrated example is coupled to the crane 400 at the second position 406 via the second fastener 410 that extends through the aperture 124 defined by the grommet 126 of the sleeve 100. For example, the second surface 408 of the crane 400 defines an aperture that receives the fastener 410 to couple the second end 108 of the sleeve 100 to the second position 406 of the crane 400. In some examples, the fastener 410 includes an assembly of a bolt (e.g., a bolt having an outer diameter of about ⅝ inches), a lock washer, a flat washer and/or a spacer. Further, in some examples, the fastener 410 and the aperture are threaded to enable the fastener 410 to threadably couple to the second position 406 of the crane 400.

The second end 108 of the sleeve 100 is coupled to the crane 400 at the second position 408 to further prevent the bumper 112 and/or a portion of the bumper 112 from falling from the crane 400 onto the ground below. In some instances, the bumper 112 may decouple and/or separate from the crane 400 and/or the fastener 202 as a result of the bumper 112 being struck by an object. As a result, the first end 106 of the sleeve 100 may decouple from the first position 402 of the crane 400. The second end 108 of the sleeve 100 is coupled to the second position 406 of the crane 400 to prevent the sleeve 100 and the bumper 112 contained within the sleeve 100 from falling to the ground below when the first end 106 decouples from the crane 400. In other words, when the first end 106 of the sleeve decouples from the crane 400, the sleeve 100 containing the bumper 112 remains coupled to the crane 400 via the second end 108 to prevent the sleeve 100 and the bumper 112 from falling to the ground below.

Figure 5:
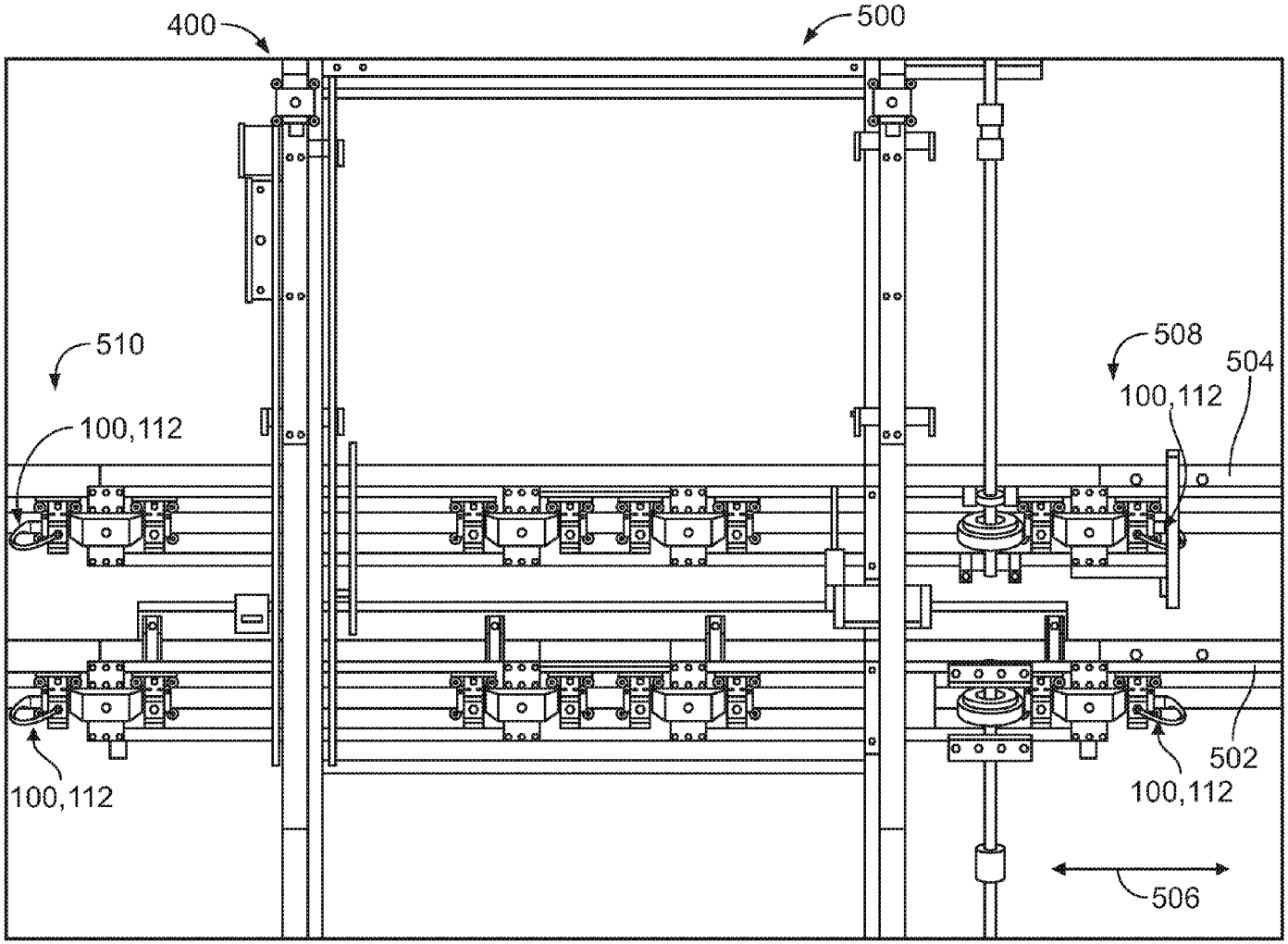
FIG. 5 depicts the sleeve and the crane bumper of FIGS. 1-3 coupled to a bridge of the crane of FIG. 4.

FIG. 5 illustrates the sleeve 100 and the bumper 112 coupled to a portion of the bridge or trolley 500 of the crane 400. In the illustrated example, four of the sleeves 100 and four of the bumpers 112 are coupled to the bridge 500. In other examples, more or less of the bumpers 112 and the sleeves 100 may be coupled to the bridge 500. As illustrated in FIG. 5, the bridge 500 is slidably coupled to a first rail 502 and a second rail 504 parallel to the first rail 502 to enable the bridge 500 of the crane 400 to move in a direction 506 parallel to the rails 502, 504 (e.g., in a left-right direction in FIG. 5). The bridge 500 moves along the rails 502, 504 to enable the crane 400 to transport materials (e.g., raw materials, works-in-progress, finished goods, etc.) in the direction 506.

A plurality of other bridges or trolleys (e.g., bridges or trolleys similar to the bridge 500) may be coupled to the rails 502, 504 to enable the crane 400 to transport simultaneously a plurality of materials in the direction 506. In some instances, one of the other bridges may collide with the bridge 500 as the other bridge and/or the bridge 500 moves along the rails 502, 504 in the direction 506. To prevent and/or reduce an amount of damage caused to the bridge 500 by such a collision, the bumpers 112 are coupled to ends 508, 510 of the bridge 500. For example, the bumpers 112 reduce the amount of damage caused to the bridge 500 by absorbing energy from the impact and/or by preventing the other bridge from contacting the ends 508, 510 of the bridge 500. The sleeves 100 contain the corresponding bumpers 112 to prevent the bumpers 112 and/or portions of the bumpers 112 from falling to the ground below. As illustrated in FIG. 5, to prevent another bridge adjacent the first end 508 of the bridge 500 from damaging the first end 508, one of the bumpers 112 and the sleeves 100 is coupled to the first end 508 of the bridge 500 adjacent the first rail 502 and another of the bumpers 112 and the sleeves 100 is coupled to the first end 508 adjacent the second rail 504. Further, to prevent another bridge adjacent the second end 510 of the bridge 500 from damaging the first end 508, one of the bumpers 112 and the sleeves 100 is coupled to the second end 510 adjacent the first rail 502 and another of the bumpers 112 and the sleeves 100 is coupled to the first end 508 adjacent the second rail 504.

Figure 6:
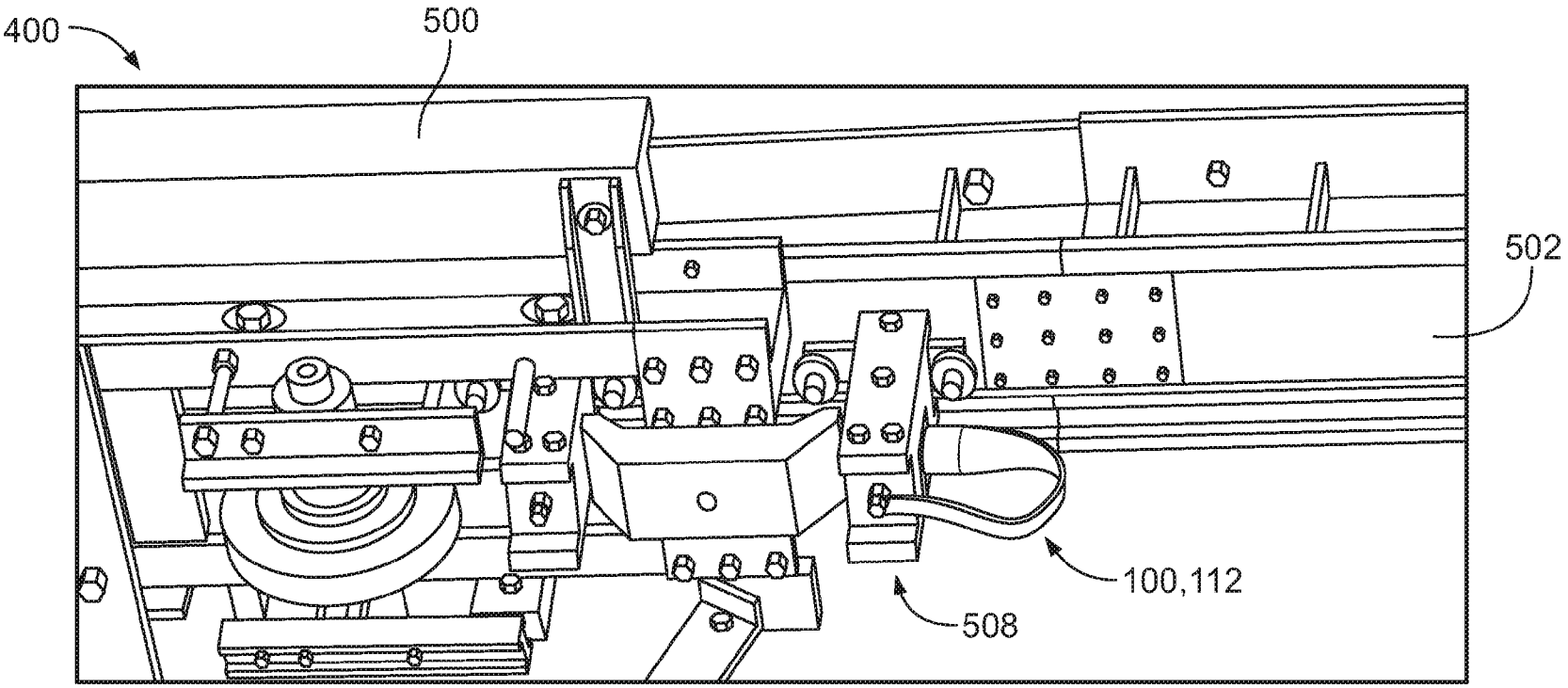
FIG. 6 is an enlarged perspective view of the sleeve and the crane bumper of FIGS. 1-3 coupled to the bridge of FIG. 5.

FIG. 6 is an enlarged perspective view of the example sleeve 100 and the bumper 112 coupled to the first end 508 of the bridge 500 of the crane 400. The sleeve 100 and the bumper 112 of the illustrated example are coupled to the first end 508 of the bridge 500 adjacent the first rail 502. As illustrated in FIG. 6, a portion of the sleeve 100 extends outward from the first end 508 of the bridge 500 beyond the bumper 112. As a result, a portion of the sleeve 100 may be stuck by an object (e.g., another bridge moving along the first rail 502) that collides with the bumper 112 coupled to the first end 508 of the bridge 500. The sleeve 100 of the illustrated example is composed of material that enables the sleeve to withstand such contact without deteriorating, tearing and/or otherwise failing to contain the bumper 112 within the sleeve 100. For example, the sleeve 100 is composed of a woven mesh of durable elastomeric material (e.g., polyphenylene sulfide) that enables the sleeve to withstand repeated collisions.

Figure 7:
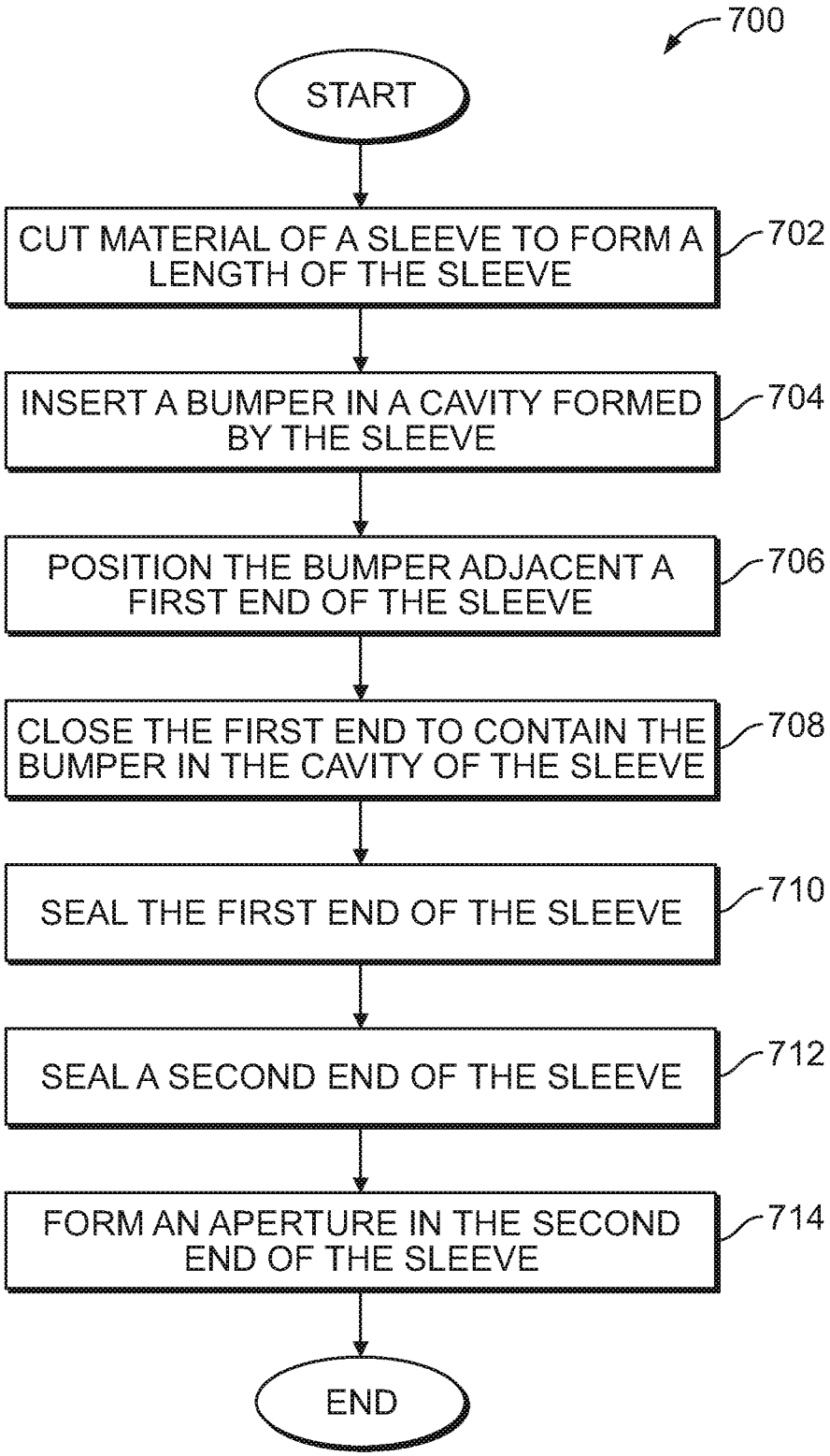
FIG. 7 is a flowchart representative of an example method to construct the example sleeve of FIGS. 1-3 in accordance with the teachings herein.

FIG. 7 is a flowchart representative of an example method 700 to assemble a sleeve in accordance with the teachings herein. Although the example method 700 is described with reference to the flowchart illustrated in FIG. 7, many other methods of assembling the sleeve may alternatively be used. For example, the order of execution of the blocks may be changed, and/or some of the blocks described changed, eliminated, and/or combined.

The example method 700 for assembling a sleeve is discussed in connection with the example sleeve 100 and the example bumper 112 of FIGS. 1-6. Further, because the example method 700 may refer to the example sleeve 100 and the example bumper 112 of FIGS. 1-6, components identified in FIGS. 1-6 having functions substantially similar or identical to the functions of components described below will not be described in detail again. Instead, the same reference numbers will be used for like structures.

The example method 700 disclosed herein starts by cutting material of the sleeve 100 to form the length 110 of the sleeve 100 (block 702). For example, the material (e.g., a flexible woven mesh of elastomeric material such as polyphenylene sulfide) is cut to the length 110 so that the sleeve 100 is long enough to enable the first end 106 to couple to the first position 402 of the crane 400 and the second end 108 to couple to the second position 406 of the crane 400. At block 704, the example method 700 includes inserting the bumper 112 into the cavity 104 formed by the sleeve 100. For example, the wall 102 of the sleeve 100 is stretched, flexed and/or otherwise expanded outward to enable the bumper 112 to be inserted into the cavity 104 of the sleeve 100. At block 706, the example method includes positioning the bumper 112 adjacent the first end 106 of the sleeve 100. For example, the bumper 112 is positioned within the cavity 104 to be adjacent the first end 106.

At block 708, the example method 700 includes closing the first end 106 of the sleeve 100 to contain the bumper 112 in the cavity 104 of the sleeve 100. Further, the example method 700 includes sealing the first end 106 of the sleeve 100 (block 710). For example, the first end 106 is sealed by forming the knot or crimp 118 in the first end 106, by coating the first end 106 with the rubber coating 120, by heating, melting and/or gluing the first end 106 together, etc. (block 710). At block 712, the example method 700 includes sealing the second end 108 of the sleeve 100. In some examples, the second end 108 is sealed by coating the second end 108 with the rubber coating 122, by heating, melting and/or gluing the first end 106 together, etc. At block 714, the example method 700 includes forming the aperture 124 in the second end 108 of the sleeve 100. For example, the aperture 124 is formed by inserting the grommet 126 in the second end 108 of the sleeve 100.

Figure 8:
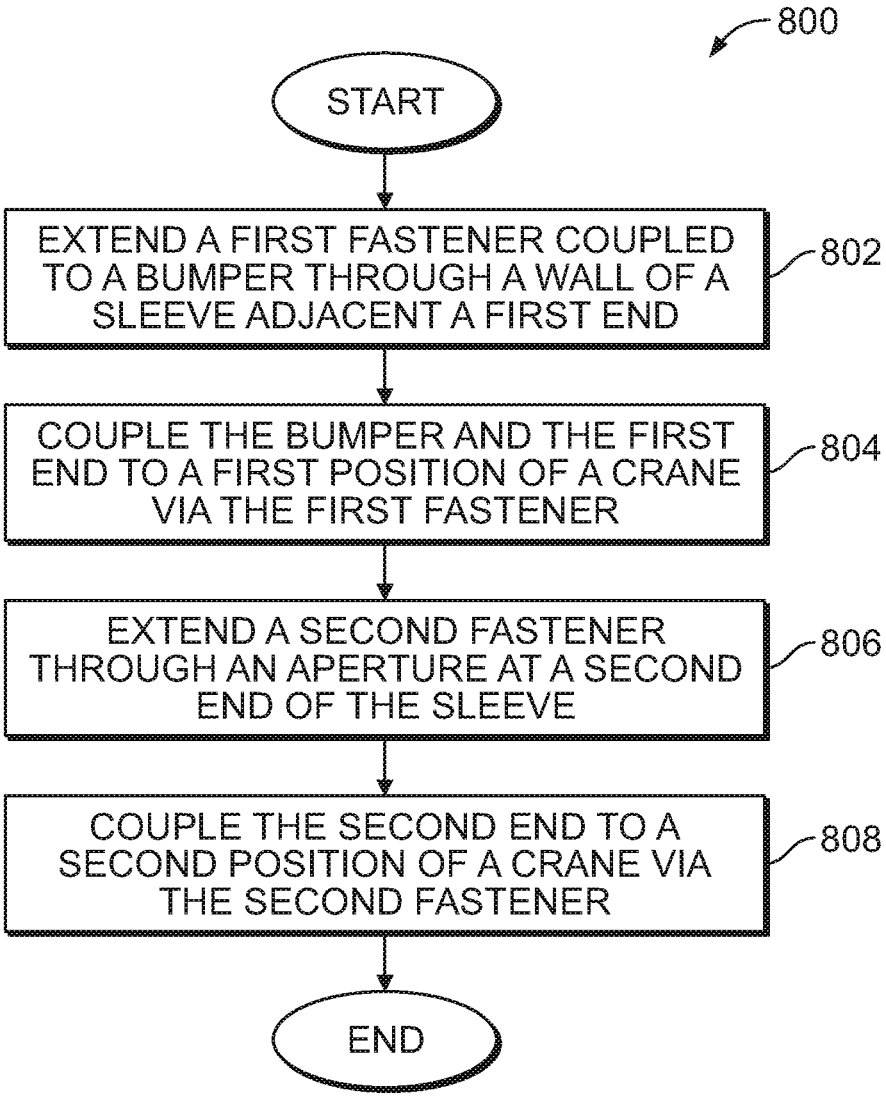
FIG. 8 is a flowchart representative of an example method to couple the example sleeve of FIGS. 1-3 to the crane of FIGS. 4-6 and/or the bridge of FIGS. 5-6 in accordance with the teachings herein.

Further, FIG. 8 is a flowchart representative of an example method 800 to couple a sleeve to a crane in accordance with the teachings herein. Although the example method 800 is described with reference to the flowchart illustrated in FIG. 8, many other methods of coupling the sleeve to the crane may alternatively be used. For example, the order of execution of the blocks may be changed, and/or some of the blocks described changed, eliminated, and/or combined.

The example method 800 for coupling a sleeve to a crane is discussed in connection with the example sleeve 100 of FIGS. 1-6, the example crane 400 of FIGS. 4-6, and/or the example bridge 500 of FIGS. 5-6. Further, because the example method 800 may refer to the example sleeve 100 of FIGS. 1-6, the example crane 400 of FIGS. 4-6 and/or the example bridge 500 of FIGS. 5-6, components identified in FIGS. 1-6 having functions substantially similar or identical to the functions of components described below will not be described in detail again. Instead, the same reference numbers will be used for like structures.

The example method 800 disclosed herein starts by extending the first fastener 202 coupled to the bumper 112 through the wall 102 of the sleeve 100 adjacent the first end 106 of the sleeve 100 (block 802). In some examples, to enable the fastener 202 to reach and extend through the wall 102 adjacent the first end 106, the sleeve 100 is bent or curled (e.g., to be about perpendicular to the fastener 202) adjacent the first end 106 and/or the bumper 112. In some examples, the fastener 202 is extended through an aperture defined by the wall 102 (e.g., a flexible mesh wall composed of an elastomeric material such as polyphenylene sulfide) without damaging the wall 102.

At block 804, the example method 800 includes coupling the bumper 112 and the first end 106 of the sleeve 100 to the first position 402 of the crane 400 via the fastener 202. For example, to couple the bumper 112 and the first end 106 to the first position 402 of the crane 400, the fastener 202 that extends through the wall 102 of the sleeve 100 is received by an aperture defined by the first surface 404 of the crane 400. In some examples, the fastener 202 is threadably coupled to the first position 402 of the crane 400 via the threads 302 of the fastener 202.

At block 806, the example method 800 includes extending the second fastener 410 through the aperture 124 defined by the second end 108 of the sleeve 100. For example, the fastener 410 is extended through the aperture 124 defined by the grommet 126 that is disposed in the second end 108 of the sleeve 100. Further, the example method 800 includes coupling the second end 108 of the sleeve 100 to the second position 406 of the crane 400 via the fastener 410 (block 808). For example, to couple the second end 108 to the second position 406, the fastener 410 that is extended through the aperture 124 of the second end 108 is received by an aperture defined by the second surface 408 of the crane 400. In some examples, the fastener 410 is threadably coupled to the second surface 408 to couple the second end 108 of the sleeve 100 to the second position 406 of the crane 400.

Although certain example apparatus and methods have been described herein, the scope of coverage of this patent is not limited thereto. On the contrary, this patent covers all methods, apparatus and articles of manufacture fairly falling within the scope of the amended claims either literally or under doctrine of equivalents.

What is claimed is:

1. An apparatus comprising:

a flexible sleeve including a wall defining a first end, a second end opposite the first end, and a cavity of the flexible sleeve; and a bumper positioned in at least a portion of the cavity of the flexible sleeve, the first end of the flexible sleeve and the bumper coupled to a first position of a crane, the second end of the flexible sleeve coupled to a second position of the crane to prevent the bumper contained in the cavity from falling from the crane if the bumper and the first end of the flexible sleeve decouple from the first position of the crane.

2. The apparatus of claim 1, further including a first fastener coupled to the bumper, the first fastener extending through an exterior surface of the flexible sleeve, the first fastener coupling the bumper and the crane.

3. The apparatus of claim 2, wherein the second end of the flexible sleeve defines an aperture to receive a second fastener that is to couple the second end of the flexible sleeve to the second position of the crane.

4. The apparatus of claim 3, wherein the aperture is defined by a grommet disposed in the second end of the flexible sleeve.

5. The apparatus of claim 2, wherein the flexible sleeve is to enable the first fastener to extend through the flexible sleeve adjacent the first end to couple the first end and the bumper to the first position of the crane.

6. The apparatus of claim 1, wherein the flexible sleeve is composed of a woven elastomeric mesh.

7. The apparatus of claim 1, wherein the first end and the second end are closed to contain a first portion of the bumper that decouples from a second portion of the bumper that remains coupled to the crane.

8. The apparatus of claim 1, wherein the bumper has a diameter of about between 1 inch and 6 inches.

9. An apparatus comprising:

a crane bumper;

a sleeve including a mesh wall containing the crane bumper, the sleeve including:

a first sealed end, the crane bumper contained by the mesh wall of the sleeve adjacent the first sealed end, a fastener coupled to the bumper extends through the mesh wall adjacent the first sealed end to couple the bumper to a first position of a crane; and a second sealed end opposite the first sealed end to couple to a second position of the crane.

10. The apparatus of claim 9, wherein the mesh wall of the sleeve is composed of polyphenylene sulfide.

11. The apparatus of claim 9, wherein the crane bumper has a diameter of about between 1 inch and 6 inches.

12. The apparatus of claim 9, wherein the first sealed end or the second sealed end is sealed via a rubber coating.

13. The apparatus of claim 9, wherein the first sealed end is sealed via knotting or crimping the sleeve.

14. The apparatus of claim 9, wherein the fastener extending through the mesh wall without damaging the mesh wall.

15. The apparatus of claim 9, wherein the sleeve and the crane bumper are coupled to an end of a bridge of the crane to prevent an object from contacting the end of the bridge.

16. The apparatus of claim 9, wherein the sleeve and the crane bumper are coupled to an end of a hoist to prevent an object from contacting the end of the hoist.

17. A method comprising:

extending a first fastener coupled to a crane bumper through a mesh wall of a sleeve adjacent a first sealed end of the sleeve, the crane bumper contained within a cavity defined by the mesh wall adjacent the first sealed end;

coupling the crane bumper and the first sealed end to a first position of a crane via the first fastener extending through the mesh wall; and coupling a second sealed end of the sleeve opposite the first sealed end to a second position of the crane to prevent the crane bumper contained within the cavity of the sleeve from falling from the crane if the first sealed end of the sleeve decouples from the first position of the crane.

18. The method of claim 17, wherein coupling the second sealed end to the second position of the crane includes extending a second fastener through an aperture defined by the second sealed end of the sleeve.

19. The method of claim 18, wherein the aperture is defined by a grommet disposed in the second sealed end of the sleeve.

20. The method of claim 17, wherein coupling the crane bumper and the first sealed end to the first position of the crane includes threadably coupling the first fastener that extends through the mesh wall of the sleeve to the first position of the crane.

* * * * *